United States Patent [19]

Bowen

[11] 4,308,975

[45] Jan. 5, 1982

[54] BEVERAGE COOLING AND DISPENSING APPARATUS

[75] Inventor: E. Lee Bowen, Michigan City, Ind.

[73] Assignee: Tyler Refrigeration Corporation, Niles, Mich.

[21] Appl. No.: 98,613

[22] Filed: Nov. 29, 1979

[51] Int. Cl.[3] ..... B67D 5/22

[52] U.S. Cl. ..... 222/36; 222/70; 222/146 C

[58] Field of Search ..... 222/146 C, 70, 132, 222/136, 399, 608, 36; 312/140.2; 62/237; 211/70, 71

[56] References Cited

U.S. PATENT DOCUMENTS

| | | | |
|---|---|---|---|
| 3,232,489 | 2/1966 | Buffington | 222/399 X |
| 3,240,395 | 3/1966 | Carver | 222/608 X |
| 3,380,629 | 4/1968 | Kontra et al. | 222/70 X |
| 3,940,019 | 2/1976 | Kross et al. | 222/129.4 X |
| 3,976,222 | 8/1976 | Spagnolo | 222/70 |
| 3,979,024 | 9/1976 | Hoppe | 222/146 C |
| 4,008,810 | 2/1977 | Merz | 211/71 |

OTHER PUBLICATIONS

The Uncorker II, 4 pp., Electronic Dispensers International.

*Primary Examiner*—Stanley H. Tollberg
*Attorney, Agent, or Firm*—LeBlanc, Nolan, Shur & Nies

[57] ABSTRACT

A beverage (wine) cooling and dispensing apparatus comprising a cabinet having an insulated internal compartment enclosing a number of different removable receptacles containing relatively large quantities of different beverages and a self-contained refrigeration system, a plurality of externally located dispensing heads projecting from the cabinet, one for each receptacle, and conduits providing pressurized flow of beverage between each receptacle and its associated dispensing head, with selectively operated controls being provided for each path including selectors at each head whereby any of a plurality of different relatively small quantities from each receptacle may be selectively dispensed.

9 Claims, 8 Drawing Figures

Fig. 1
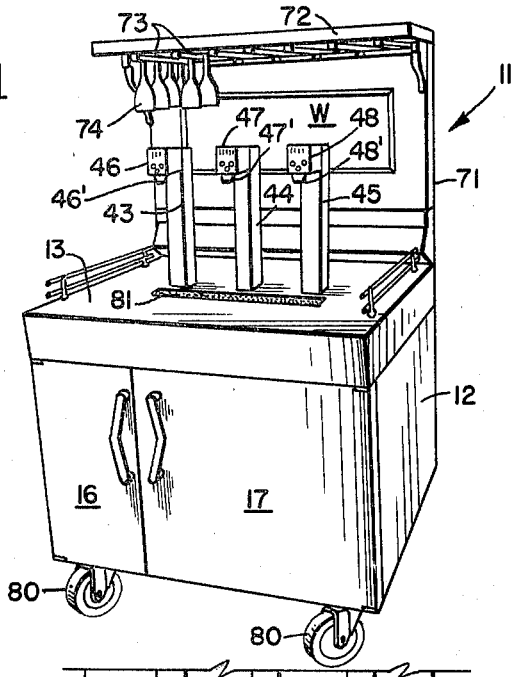
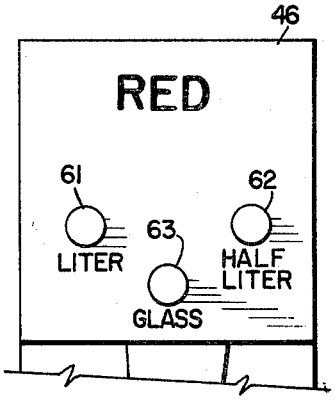
Fig. 4
Fig. 2
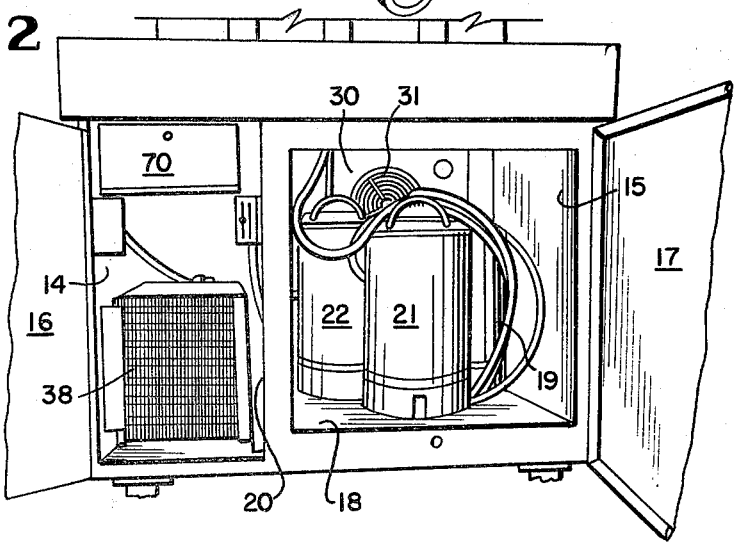
Fig. 3
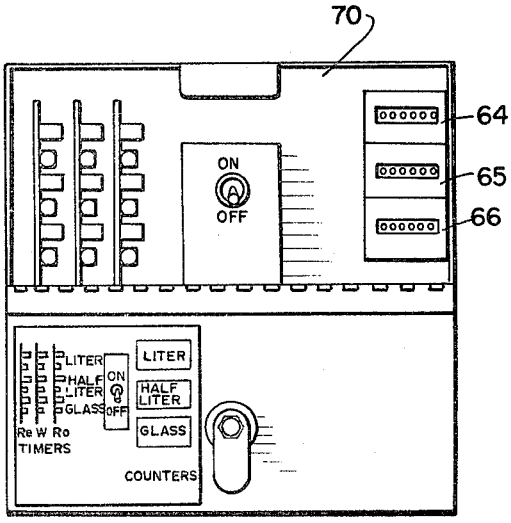

BEVERAGE COOLING AND DISPENSING APPARATUS

This invention relates to the dispensing of cooled beverages, notably wine, and particularly to special apparatus whereby any of a plurality of selected cooled beverages may be dispensed in any of a plurality of preselected quantities.

In its preferred form the invention will be described as incorporated in apparatus for rapidly dispensing a selected wine, usually in quantities for direct table use, such as by the glass, half-liter or liter. It will be understood that the general principles and the novel structure detailed in the claims are not limited to wine dispensing.

It has become more customary in America, especially among people who have toured Europe, to drink wine at the table during lunch and/or dinner. Bottles and half-bottles are available but they may represent the higher priced wines, or too much wine for the individual or individuals at the tables. Hence it has become the practice for restaurants to offer wine by the glass or in half-liter or liter carafes. These are usually domestic or lower priced popular wines, so that the prices and quantities are right for most people.

White and rose wines are usually served cooled, and while the high priced red wines are usually served at room temperature many people prefer popular red wines cooled.

The present invention provides a self-contained apparatus having its own storage and cooling system, with appropriate facilities and controls for selectively dispensing different quantities of selected wines, and this is the major object. Pursuant to this object the apparatus may be portable, being preferably mounted on wheels so that it may be moved to and from tables in a restaurant, thereby eliminating the need for the waiter to carry the wine long distances and assuring that the wine is cool as delivered at the table.

A further object of the invention is to provide a novel wine or like cooling and dispensing apparatus wherein the wines are stored in replaceable receptacles in an insulated compartment that is cooled by a self-contained refrigerator system in the apparatus, and the wines are dispensed through accessible heads having controls regulating discharge of wine from the respective receptacles.

Another object of the invention is to provide a novel wine or like cooling and dispensing apparatus having novel internal compartment arrangements accommodating replaceable wine receptacles, a refrigeration system, external dispensing heads and conduits between the receptacles and respective heads, and special controls for selective quantity dispensing of wine from any of the receptacles.

Further objects will appear as the description proceeds in connection with the appended claims and the accompanying drawings.

BRIEF DESCRIPTION OF DRAWINGS

FIG. 1 is a generally perspective view showing a wine cooling and dispensing unit according to a preferred embodiment of the invention;

FIG. 2 is a front view of the cabinet part of the unit of FIG. 1 with front doors open to show the internal compartments and general arrangement of parts;

FIG. 3 is an enlarged view of the upper part of the non-cooled compartment showing detail of controls;

FIG. 4 is an enlarged view of a selector-dispensing head;

PREFERRED EMBODIMENT

Figure 5:
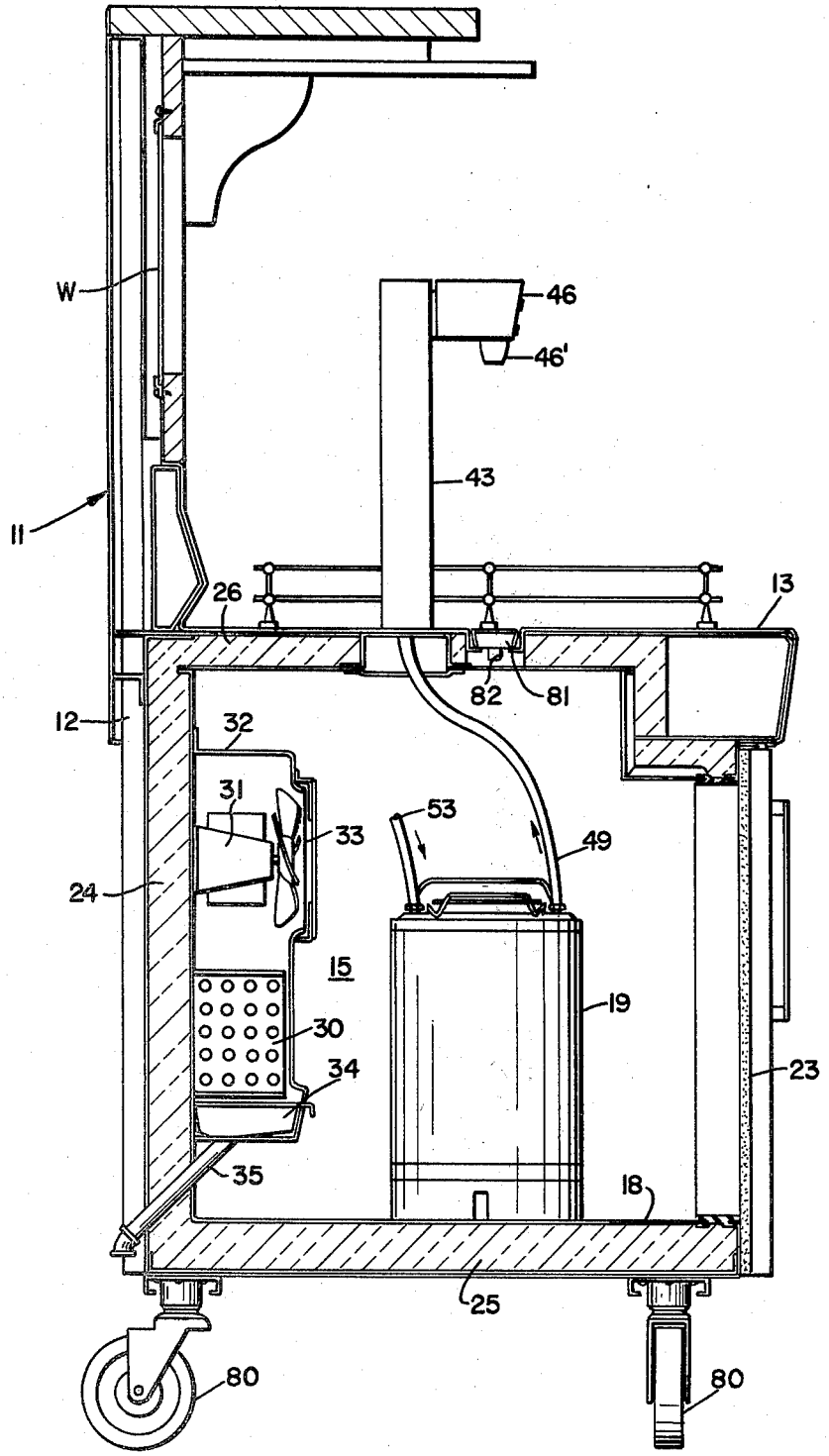
FIG. 5 is a side elevation partly broken away and sectioned showing internal detail.

Referring to the drawings the unit 11 is self-contained and may be portable. It incorporates its own complete refrigerating system, and it may be mounted on casters enabling it to be moved about, as in a restaurant from table to table. In general the unit comprises a lower cabinet 12 having a flat table-like top 13. Cabinet 12 is separated internally by a vertical wall 20 into compartments 14 and 15 to which access is controlled by hinged doors 16 and 17 respectively.

Compartment 15 has a flat floor 18 supporting three relatively large receptacles 19, 21 and 22. In the preferred embodiment these receptacles contain different wines, such as red wine at 19, white wine at 21 and rose wine at 22. These receptacles are separate and readily removable from the compartment for refill or substitution. Each receptacle may be of stainless steel and may contain about three to five gallons of wine for example.

In compartment 15 the wine is refrigerated and maintained at a constant temperature, preferably in the range of 45 degrees F. to 60 degrees F. The walls bounding compartment 15 are heat insulated. For example as shown in FIG. 5 inner sides of the doors are insulated as indicated at 23, the rear wall has an insulation layer indicated at 24, a layer of insulation 25 is provided under bottom wall 18 and a layer of insulation 26 underlies the top wall 13. Wall 20 has high insulation properties, as well as the outer side wall of compartment 15 that is parallel to wall 20. Thus compartment 15 is effectively insulated against heat transfer through its walls.

Figure 6:
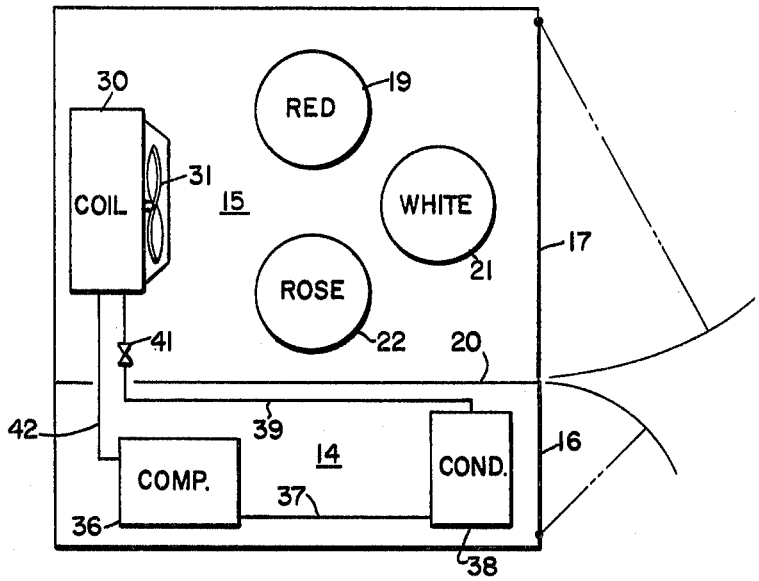
FIG. 6 is a diagrammatic plan view illustrating the arrangement of the cooling system components.

FIG. 6 diagrammatically shows the disposition of the components of the refrigeration system in the cabinet. The evaporator coil system comprising the cooling element 30 is mounted by a suitable bracket upon the back wall of compartment 15 containing the wine receptacles. Above cooling element 30 an electric fan 31 is mounted on the back wall of compartment 15 for promoting circulation of air within the compartment and through the coils. A suitable sheet metal cover 32 is attached to the compartment back wall, with an opening 33 in front of the fan, and it carries a drip tray 34 for accumulation of defrost water. A drain 35 leads through the compartment back wall for disposal of defrost water.

A compressor 36 mounted in the rear of compartment 14 is connected by conduit 37 to a condenser 38 to the front of compartment 14. A conduit 39 conducts liquid refrigerant through expansion valve 41 to the evaporator coil system 30, and a return conduit 42 connects the coil system to the compressor. Compartment 14 need not be insulated but the conduit 39 is preferably insulated as it extends along or in wall 20, and the opening in wall 20 for passing the conduits is shown exaggeratedly large for clarity of disclosure. In practice it is as small as possible for minimum heat transfer.

Upstanding from table 13 are three similar hollow side by side spaced posts 43, 44 and 45. These posts terminate in dispensing heads 46, 47 and 48 respectively having discharge spouts 46', 47' and 48'. A length of plastic tubing 49 (FIG. 5) extends from receptacle 19 up through the post 43 to head 46. Similar lengths of flexible plastic tubing extend similarly between receptacle 21 and head 47 and between receptacle 22 and head 48.

Figure 7:
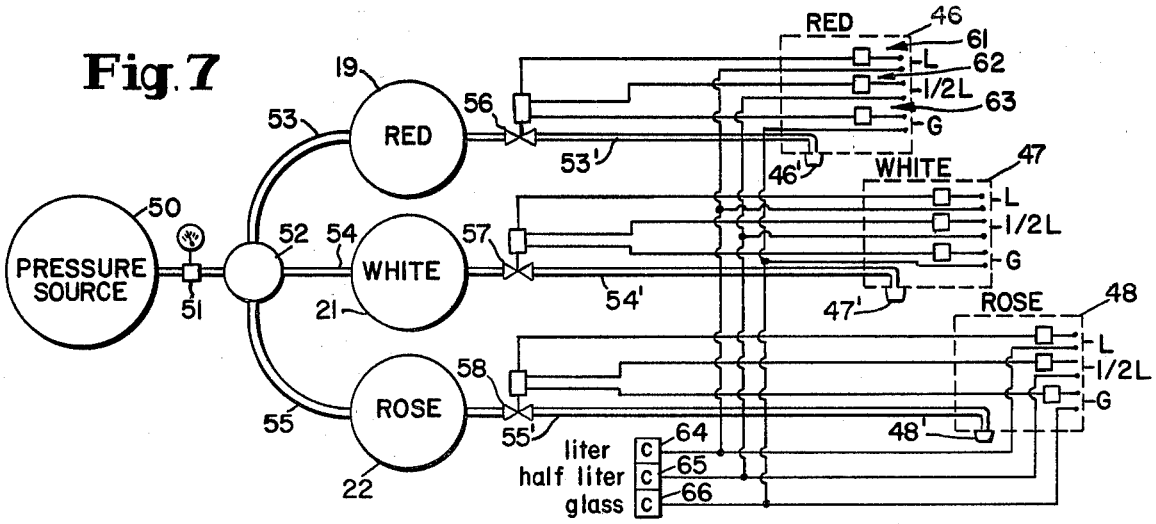
FIG. 7 is a diagrammatic view showing the controls for selective dispensing of the different wines.

The wine dispensing system is diagrammatically shown in FIG. 7. A self-contained source 50 of fluid pressure is connected through an adjustable pressure regulator 51 to a pressure chamber 52. Conduits 53, 54 and 55 connect chamber 52 into the respective receptacles 19, 21 and 22 so that the receptacles are internally pressurized. Receptacles 19, 21 and 22 are connected to heads 46, 47 and 48 by conduits 53', 54' and 55', respectively. Normally closed solenoid valves 56, 57 and 58 are disposed in the respective conduits 53', 54' and 55', and the solenoids are electrically connected to switching arrangements in the respective dispensing heads.

The pressure source 50 is preferably a standard type tank of liquified nitrogen or an equivalent pressurized fluid that will not affect the taste of the wine, and pressure regulator 51 is usually in the fittings supplied with such tanks. This tank is readily removable and replaceable by the user of the unit. Nitrogen gas is preferred because it is tasteless and odorless.

Referring to FIGS. 4 and 7, it will be seen that head 46 is for red wine and contains three switch operator buttons marked L (liter), ½ L (half-liter) and G (glass). These buttons may be selectively pressed to close respective time controlled switches 61, 62 and 63. Thus when button L is pushed, switch 61 is closed to open valve 56 for a predetermined time to allow the pressure of the nitrogen gas to force red wine out of receptacle 19 to dispense a liter of wine into a flask placed below head 46. When a liter has been dispensed the valve 56 recloses.

Similarly the time controlled switches 62 and 63 may be selectively operated to dispense a half-liter or a glass of red wine through their respective heads. As shown in FIG. 7 the foregoing dispensing arrangement is duplicated for selectively dispensing three different volumes of wine from the white receptacle 21 and the rose receptacle 22.

As shown in FIG. 3 and FIG. 7 as the wine is dispensed respective counters 64, 65 and 66 are actuated, and these counters are of the non-settable digital type. The restaurant owner can thus tell how many portions of each quantity are dispensed.

Power is supplied to the unit by an electric supply line (not shown) leading into the control section 70 shown in FIG. 3. This section in practice contains the various time control switches and any other electrical control devices, and is preferably built up of standard units for accomplishing the different required functions.

Behind posts 43–45 the rear of the cabinet extends upwardly in a standard 71 and terminates in a forwardly extending shelf 72 formed with notches 73 to slidably receive glasses 74 for ready access to the user. Standard 71 is apertured above the table and a removable ornamental glass window W is provided in the aperture.

As mentioned above the entire unit may be moved about, supported on caster wheels 80 depending from the bottom of the cabinet.

As shown in FIGS. 1 and 5 the upper surface 13 of the table may be depressed for an area extending beneath the three dispensing heads as indicated at 81, to provide a drain trough. A discharge conduit 82 is provided for trough 81.

Figure 8:
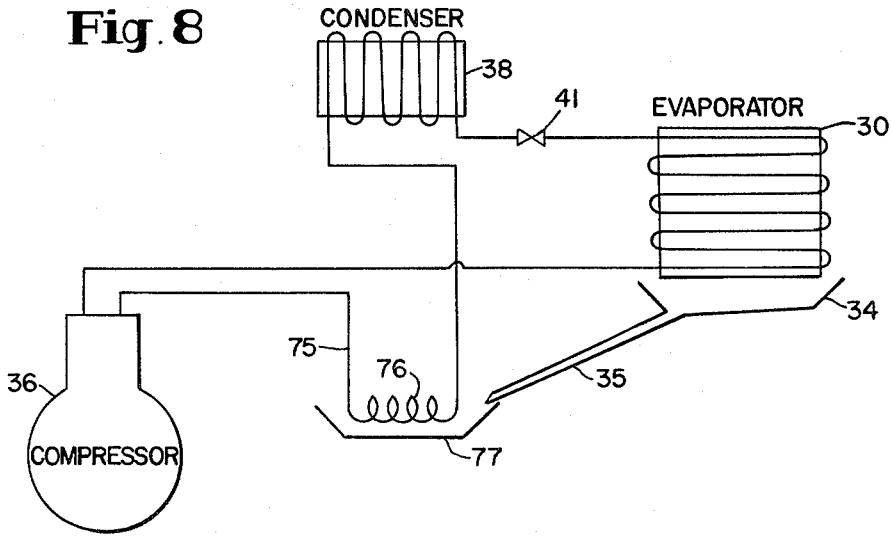
FIG. 8 is a diagrammatic view showing an embodiment wherein heat from the compressed refrigerant gas is used to evaporate defrost water from the cooling coils.

FIG. 8 illustrates an embodiment wherein heat from the compressed refrigerant fluid is utilized to evaporate defrost water. As shown the refrigerant cycle is the same as in FIG. 6, but here the conduit 75 between the compressor and the condenser contains a heat exchange coil 76 disposed in a tray or pan 77 located to receive water from drain 35.

Thus when the refrigeration system is shut down thus defrosting the coils at 30, defrost water flows into pan 77, and when the system is rendered operative again that water is evaporated due to heat exchange at coil 76. This also helps reduce the cooling required at the condenser.

Power for driving the compressor may be obtained from a suitable plug in lead wire which may be disconnected for long periods without affecting the temperature of the wine due to the effectively insulated nature of compartment 15. When not being wheeled to a table the unit may be reconnected to energize the refrigeration system.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A beverage cooling and dispensing apparatus comprising a cabinet having a first internal compartment all of the walls of which are insulated against heat exchange and wherein a number of different receptacles each containing a relatively large quantity of beverage may be removably disposed, means in said cabinet providing an adjacent second internal compartment, means providing a self-contained refrigeration system within said cabinet including a cooling device for continually providing cooled air in said first compartment whereby said first compartment may be maintained at a desired low temperature, said refrigeration system comprising operatively interconnected compressor, cooling coil and condenser units with the compressor and condenser being mounted in said second compartment and said cooling coil being comprised in said cooling device and disposed in said first compartment, a plurality of externally located dispensing heads projecting from said cabinet, one for each receptacle, means including conduit means for providing a pressurized beverage flow path between each receptacle and its associated dispensing head, and selectively operated control means for each path including timed selector means in each head whereby any of a plurality of different relatively small quantities from each receptacle may be dispensed.

2. The apparatus defined in claim 1, wherein said cooling coil is mounted on the rear wall of said first compartment and said cooling device includes a means for circulating air in said first compartment.

3. The apparatus defined in claim 1, wherein a solenoid valve is disposed in each of said conduit means, and wherein a plurality of time control switches operatively located to respective valves are provided in each head, whereby operation of a different switch at each head results in dispensing a predetermined different quantity of beverage through that head.

4. The apparatus defined in claim 1, wherein irreversible counter means is connected to said switch means to record the quantities dispensed.

5. The apparatus defined in claim 1, wherein said receptacles are stainless steel containers and said conduit means comprises flexible plastic tubing detachably connected to said containers.

6. The apparatus defined in claim 1, wherein said control means comprises a plurality of time controlled switches at each head, the switches at each head when selectively closed being adapted to actuate a solenoid valve in the associated conduit to dispense different predetermined quantities of beverage through that head.

7. The apparatus defined in claim 1, wherein said heads similarly upstand from a flat table-like top of said cabinet, and a standard upstands from the rear of said cabinet and terminates in an overhanging upper shelf having drinking glass mounting formations accessible to an operator at any of said heads.

8. The apparatus defined in claim 1, wherein said receptacles contain different beverages, such as red, white and rose wine respectively.

9. The apparatus defined in claim 1, wherein said conduits are connected through a common pressure distribution chamber to a source of pressurized fluid that is inert with respect to the dispensed beverage.

* * * * *